US011725294B2

(12) United States Patent
Ma et al.

(10) Patent No.: US 11,725,294 B2
(45) Date of Patent: Aug. 15, 2023

(54) METHODS FOR PARTIAL GOLD PLATING OF METAL PACKAGING HOUSINGS AND PACKAGING HOUSINGS THEREOF

(71) Applicant: HEFEI SHENGDA ELECTRONICS TECHNOLOGY INDUSTRY CO., LTD., Hefei (CN)

(72) Inventors: Xiao Ma, Hefei (CN); Lei Yang, Hefei (CN); Huasan Chen, Hefei (CN); Zhengsheng Tang, Hefei (CN); Jin Sun, Hefei (CN); Bo Zhou, Hefei (CN); Minglong Wang, Hefei (CN)

(73) Assignee: HEFEI SHENGDA ELECTRONICS TECHNOLOGY INDUSTRY CO., LTD, Hefei (CN)

( * ) Notice: Subject to any disclaimer, the term of this patent is extended or adjusted under 35 U.S.C. 154(b) by 0 days.

(21) Appl. No.: 18/048,510

(22) Filed: Oct. 21, 2022

(65) Prior Publication Data

US 2023/0175157 A1 Jun. 8, 2023

(30) Foreign Application Priority Data

Dec. 8, 2021 (CN) ..... 202111492633.5

(51) Int. Cl.

| | |
|---|---|
| ***C25D 3/14*** | (2006.01) |
| ***C25D 3/48*** | (2006.01) |
| ***C25D 5/34*** | (2006.01) |
| ***C25D 13/18*** | (2006.01) |
| ***C25D 5/12*** | (2006.01) |
| ***C25D 5/02*** | (2006.01) |

(52) U.S. Cl.

CPC ..... *C25D 3/14* (2013.01); *C25D 3/48* (2013.01); *C25D 5/02* (2013.01); *C25D 5/12* (2013.01); *C25D 5/34* (2013.01); *C25D 13/18* (2013.01)

(58) Field of Classification Search

None

See application file for complete search history.

(56) References Cited

U.S. PATENT DOCUMENTS

| | | | |
|---|---|---|---|
| 2009/0127121 | A1 | 5/2009 | Basker et al. |
| 2015/0004478 | A1 | 1/2015 | Prinzbach et al. |

FOREIGN PATENT DOCUMENTS

| | | | | |
|---|---|---|---|---|
| CN | 102703885 | A | * | 10/2012 |
| CN | 104109887 | A | * | 10/2014 |
| CN | 104109887 | A | | 10/2014 |
| CN | 110344092 | A | * | 10/2019 |

(Continued)

OTHER PUBLICATIONS

First Office Action in Chinese Application No. 202111492633.5 dated Jul. 18, 2022, 12 pages.

(Continued)

*Primary Examiner* — Louis J Rufo

(74) *Attorney, Agent, or Firm* — Metis IP LLC

(57) ABSTRACT

The present disclosure involves a method for partial gold plating of a metal packaging housing and a packaging housing thereof. The packaging housing may include a base. The base may be provided with at least one lead hole. A housing lead may be interspersed in the lead hole. The lead hole may be also provided with an insulator surrounding the housing lead. The method may include operations such as nickel plating, oxidation, gold plating, reduction, etc.

15 Claims, 3 Drawing Sheets

(56) References Cited

FOREIGN PATENT DOCUMENTS

| | | | |
|---|---|---|---|
| CN | 110344092 | A | 10/2019 |
| CN | 111270250 | A | 6/2020 |
| CN | 111962117 | A | 11/2020 |
| CN | 112195500 | A | 1/2021 |
| CN | 112813472 | A | 5/2021 |
| JP | H09167810 | A | 6/1997 |

OTHER PUBLICATIONS

Decision to Grant a Patent in Chinese Application No. 202111492633.5 dated Jul. 27, 2022, 3 pages.
Xu, Weiyuan et al., Study of Selective Gold Plating Technique on Leads of the Hybrid Integreted Circuit, Plating and Finishing, (22) 4: 5-7, 2000.

* cited by examiner

METHODS FOR PARTIAL GOLD PLATING OF METAL PACKAGING HOUSINGS AND PACKAGING HOUSINGS THEREOF

CROSS-REFERENCE TO RELATED APPLICATIONS

This application claims priority of Chinese Patent Application No. 202111492633.5, filed on Dec. 8, 2021, the entire contents of which are hereby incorporated by reference.

TECHNICAL FIELD

The present disclosure relates the technical field of packaging surface processing, and in particular to methods for partial gold plating of metal packaging housings and packaging housings thereof.

BACKGROUND

A metal packaging housing may be generally composed of a housing base, a lead and an insulator. Generally speaking, an internal electronic component such as a chip, a capacitor, etc. may need to be welded in the base of the housing. If the base is gold-plated, gold brittleness may occur after long-term use after soldering, which may reduce reliability of soldering and affect reliability of an entire packaging component. The housing lead may be gold-plated to ensure bonding strength and solderability of the lead. Different from a parallel sealing and capping technology, a sealing and welding surface of the metal packaging housing of a laser capping may not include a gold-plated layer. Existence of the gold-plated layer may reduce efficiency of laser welding, thereby affecting reliability of the capping. In addition, for the manufacturing cost of the housing, the gold plating cost of the base may account for more than 90% of an entire gold plating cost of the housing. Therefore, using the partial gold plating technology of the housing lead can not only improve reliability of such products, but also can significantly reduce the manufacturing cost.

At present, there may be two more commonly used manners for the partial gold plating technology of the housing lead of the metal packaging housing. One manner may be to perform chemical nickel-phosphorus plating on an entire outer surface of the housing, and place the base and the lead into a gold-plating solution for individual gold plating after the base is powered off and the lead is powered on. The manner may achieve an effect of preventing replacement of a nickel plating layer using a principle that an electrode potential of an electroless nickel plating layer is similar to that of a gold plating layer. The process may have poor stability during practical application. If process parameters are not properly controlled, it may be easy to replace a gray thin gold layer on a surface of the electroless nickel plating layer, which may require a subsequent gold withdrawal processing. However, it is necessary to control a state of a lead gold layer when the gold is withdrawn. If the gold withdrawal process is not properly controlled, a color difference of the lead gold layer may be formed or even a thickness of the gold plating layer may be insufficient. In addition, electroless nickel plating layer on the lead may increase stress of the plating layer, which may reduce bending times of the lead and affect air tightness. Moreover, a military standard also clearly stipulates that the electroless nickel plating process is prohibited for a housing of a flexible lead, resulting in certain limitations of the manner. Another manner may be to plate a thin layer of gold on an entire outer surface of the housing, continue the gold plating after powering off the base and powering on the lead, and place the lead and the base in a nickel plating solution for nickel plating after powering off the lead and powering on the base when a thickness of a gold plating layer of the lead meets a requirement. The process may achieve an effect of preventing replacement by burying a thin layer of gold on the base. The process may be not suitable for a housing of a laser sealing and capping, and the thin layer of gold buried on the base may also increase production costs.

Therefore, it is necessary to provide methods for partial gold plating of metal packaging housings and packaging housings so as to improve stability of the packaging housing and reduce manufacturing cost.

SUMMARY

One of the embodiments of the present disclosure provides a method for partial gold plating of a metal packaging housing. The packaging housing may include a base. The base may be provided with at least one lead hole. A housing lead may be interspersed in the lead hole. The lead hole may be also provided with an insulator surrounding the housing lead. The method may include follow operations: S1, nickel plating; powering on the base and the housing lead, and forming a nickel layer by performing nickel plating on the packaging housing as a whole; S2, oxidation; powering off the housing lead, powering on the base and place the base in an alkaline solution for oxidation to form an oxide layer on a surface of the nickel layer covering the base; S3, gold plating; powering off the base, powering on the housing lead, and forming a gold layer on a surface of the housing lead by performing gold plating on the housing lead; and S4, reduction; placing the packaging housing in a high temperature environment, and obtaining a partial gold-plated packaging housing by reducing the oxide layer on the surface of the nickel layer of the base using reducing gas.

In some embodiments, in S1, the nickel plating may include operations: S11, impactive nickel plating, placing the packaging housing in a impactive nickel solution after powering on the base and the housing lead for plating at a solution temperature of 30° C.-60° C. for 0.5 minutes-2 minutes, powering off the base and the housing lead, taking out the packaging housing, and washing residual impactive nickel solution with water; and S12, nickel electroplating, placing the packaging housing plated with impactive nickel in a nickel sulfamate solution for plating at a solution temperature of 30° C.-60° C. for 20 minutes-40 minutes, powering off the base and the housing lead, taking out the packaging housing, and washing residual nickel sulfamate solution with water.

In some embodiments, each liter of the impactive nickel solution may include 50 mL-200 mL of concentrated hydrochloric acid with a mass fraction of 37.5% and 40 g-65 g of nickel chloride, and the balance may be deionized water.

In some embodiments, each liter of the nickel sulfate solution may include 300 g-450 g of nickel sulfamate, 5 g-15 g of nickel chloride, 25 g-50 g of boric acid, and 0.1 g-1 g of sodium dodecyl sulfonate, and the balance may be deionized water .

In some embodiments, in S2, the oxidation may include operations: after the base is powered on, placing the base as an anode in the alkaline solution for oxidation, a current density may be within a range of 0.1 $A/dm^2$-10 $A/dm^2$, and an oxidation time may be within a range of 0.1 minutes-10 minutes.

In some embodiments, the alkaline solution may include at least one of sodium hydroxide, sodium carbonate, or sodium phosphate, and at least one of 2-mercaptobenzoxazole or 2-mercaptobenzothiazole.

In some embodiments, a mass volume concentration of the sodium hydroxide may be within a range of 1 g/L-10 g/L.

In some embodiments, a mass volume concentration of the sodium carbonate may be within a range of 1 g/L-10 g/L.

In some embodiments, a mass volume concentration of the sodium phosphate may be within a range of 1 g/L-10 g/L.

In some embodiments, a mass volume concentration of the 2-mercaptobenzoxazole may be within a range of 0.1 g/L-5 g/L.

In some embodiments, a mass volume concentration of the 2-mercaptobenzothiazole may be within a range of 0.1 g/L-5 g/L.

In some embodiments, in S3, the gold plating may include operations: S31, impactive gold plating, powering off the base, powering on the housing lead and placing the housing lead in a impactive gold solution for plating at a solution temperature of 30-60° C. for 0.1 minutes-2 minutes, powering off and taking out the housing lead, and washing residual impactive gold solution with water; and S32, gold electroplating, placing the packaging housing plated with impactive gold in a gold plating solution while keeping the housing lead powered on for plating at a solution temperature of 40° C.-70° C. for 3 minutes-10 minutes, taking out the packaging housing after powering off the housing lead, and washing residual gold plating solution with water.

In some embodiments, each liter of the impactive gold solution may include 0.2 g-2 g of potassium aurous cyanide, and 10 g-40 g of potassium cyanide, and the balance may be deionized water.

In some embodiments, the gold plating solution may be a neutral cyanide gold plating solution or an alkaline cyanide gold plating solution.

In some embodiments, each liter of the neutral cyanide gold plating solution may include 4 g-7 g of potassium aurous cyanide, 1 g-3 g of potassium nickel cyanide, and 15 g-25 g of dipotassium hydrogen phosphate, and the balance may be deionized water.

In some embodiments, each liter of the alkaline cyanide gold plating solution may include 1 g-8 g of potassium aurous cyanide, 10 g-20 g of potassium cyanide, 10 g-20 g of potassium carbonate, and 15 g-25 g of dipotassium hydrogen phosphate, and the balance may be deionized water.

In some embodiments, the reducing gas may include at least one of hydrogen, carbon monoxide, a gas mixture of nitrogen and hydrogen, a gas mixture of hydrogen and inert gas, a gas mixture of carbon monoxide and nitrogen, or a gas mixture of carbon monoxide and inert gas.

In some embodiments, in S4, the reducing gas may be a gas mixture of nitrogen and hydrogen, and a volume fraction of hydrogen in the gas mixture of nitrogen and hydrogen may be within a range of 1%-99%, and a processing temperature may be within a range of 200° C.-400° C.

In some embodiments, the method may further include pre-processing before S1, and the pre-processing may include operations: S01, sand blasting, grinding the packaging housing under 0.1 $kg/cm^2$-3 $kg/cm^2$ punching using sand; S02, degreasing, soaking the ground packaging housing in a degreasing solution with a temperature of 50° C.-70° C. for 5 minutes-15 minutes, taking out and rinsing the packaging housing with water; and S03, pickling, soaking the degreased packaging housing in a pickling solution with a temperature of 40° C.-70° C. for 0.1 minutes-2 minutes, taking out and rinsing the packaging housing with water.

In some embodiments, the sand may include at least one of silicon carbide sand, copper ore sand, quartz sand, diamond sand, or iron sand.

In some embodiments, a granularity of the sand may be within a range of 100 mesh-400 mesh.

In some embodiments, each liter of the degreasing solution may include 60 g-80 g of sodium hydroxide, 30 g-50 g of sodium carbonate, 10 g-20 g of sodium metasilicate, 3 g-5 g of sodium dodecyl sulfonate, and the balance may be deionized water.

In some embodiments, each liter of the pickling solution may include 300 mL-600 mL of concentrated hydrochloric acid with a mass fraction of 37.5%, and the balance may be deionized water.

One of the embodiments of the present disclosure also provides a packaging housing. The packaging housing may be prepared using the above method for partial gold plating of a metal packaging housing. A nickel layer may be provided on a surface of a base of the packaging housing, and a gold layer may be provided on a surface of a housing lead of the packaging housing.

In some embodiments, a thickness of the nickel layer may be within a range of 2.5 μm-8.9 μm, and a thickness of the gold layer may be within a range of 1.3 μm-5.7 μm.

The beneficial effect of the present disclosure may be as follows:

1) A key to the partial gold plating technology of the lead is that the base of the housing does not replace the gold plating layer in the gold plating solution. When a potential difference between the electrode potential of the nickel plating layer of the base in the gold plating solution and the gold itself is as small as possible, displacement of gold may be effectively slowed down. In the present disclosure, the nickel-plated base may be used as an anode, and anode electrolysis may be performed in an alkaline solution, so that an oxide film may be formed on the surface of the nickel-plated base to significantly increase the electrode potential. The existence of the oxide film can greatly reduce a rate of a replacement reaction of the base in the gold plating solution, and improve stability of the packaging housing.

2) Before nickel plating, a sandblasting step may be also added in the present disclosure. The surface of the packaging housing may be roughened and leveled by sandblasting to improve the surface roughness of the packaging housing. The greater the roughness of the surface of the packaging housing is, the higher the electrode potential of the surface of the packaging housing after anodization is, and the lower the rate of the replacement reaction is, which can further reduce a replacement speed with the gold plating solution.

3) Before the nickel electroplating and the gold electroplating, the impactive nickel plating and the impactive gold plating may be added respectively, which can improve bonding force between the packaging housing and the nickel layer, and the nickel layer and the gold layer, thereby improving strength of the plating layer, and improving reliability of the packaging.

4) The base of the packaging housing prepared by the method for the partial gold plating in the present disclosure may not include a buried gold plating layer. A preparation process of the packaging housing may be significantly shortened, the manufacturing cost may be significantly reduced, which may have good promotion and application potential.

5) The packaging housing provided by the present disclosure may not include the electroless nickel plating layer, and bending resistance of the housing lead can be better under a condition of a same thickness of the nickel layer. At the same time, the packaging housing may meet a capping requirement such as laser welding capping, parallel sealing and capping, or the like. The capping type may have wide application and broad application prospects.

Figure 1:
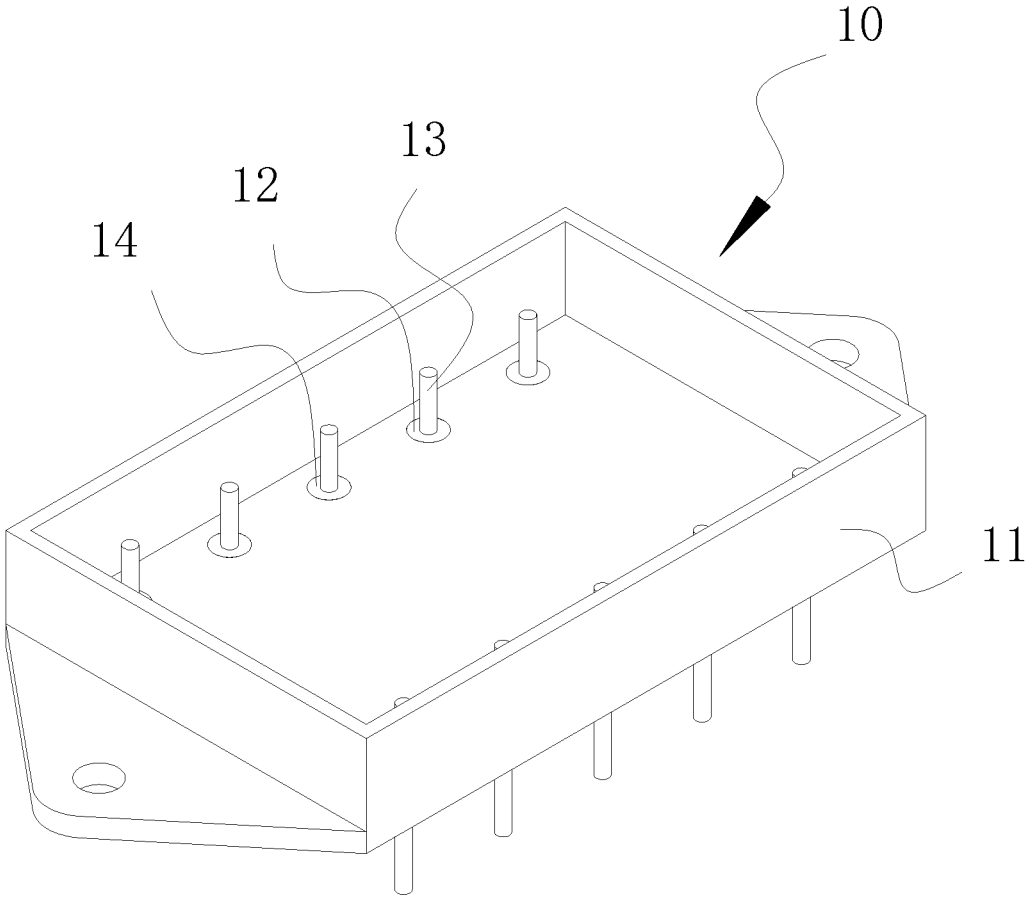
FIG. 1 is a schematic structural diagram illustrating an exemplary packaging housing according to some embodiments of the present disclosure.

Meanings of symbols in the drawings are as follows: 10: a packaging housing, 11: a base, 12: a lead hole, 13: a housing lead, 14: an insulator.

DETAILED DESCRIPTION

In order to more clearly illustrate the technical solutions related to the embodiments of the present disclosure, a brief introduction of the drawings referred to the description of the embodiments is provided below. Obviously, the drawings described below are only some examples or embodiments of the present disclosure. Those having ordinary skills in the art, without further creative efforts, may apply the present disclosure to other similar scenarios according to these drawings. Unless obviously obtained from the context or the context illustrates otherwise, the same numeral in the drawings refers to the same structure or operation.

As used in the disclosure and the appended claims, the singular forms "a," "an," and "the" include plural referents unless the content clearly dictates otherwise; the plural forms may be intended to include singular forms as well. In general, the terms "comprise," "comprises," and/or "comprising," "include," "includes," and/or "including," merely prompt to include steps and elements that have been clearly identified, and these steps and elements do not constitute an exclusive listing. The methods or devices may also include other steps or elements.

The flowcharts used in the present disclosure illustrate operations that systems implement according to some embodiments in the present disclosure. It is to be expressly understood, the operations of the flowchart may be implemented not in order. Conversely, the operations may be implemented in inverted order, or simultaneously. Moreover, one or more other operations may be added to the flowcharts. One or more operations may be removed from the flowcharts.

Figure 2:
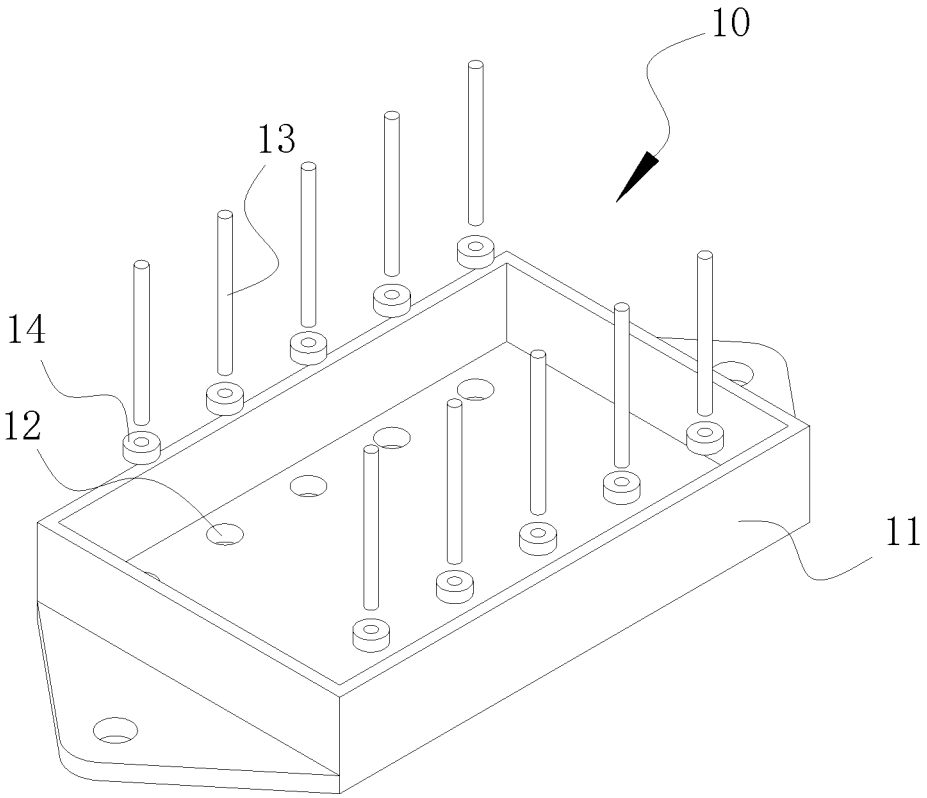
FIG. 2 is an exploded view illustrating a packaging housing according to some embodiments of the present disclosure.
Figure 3:
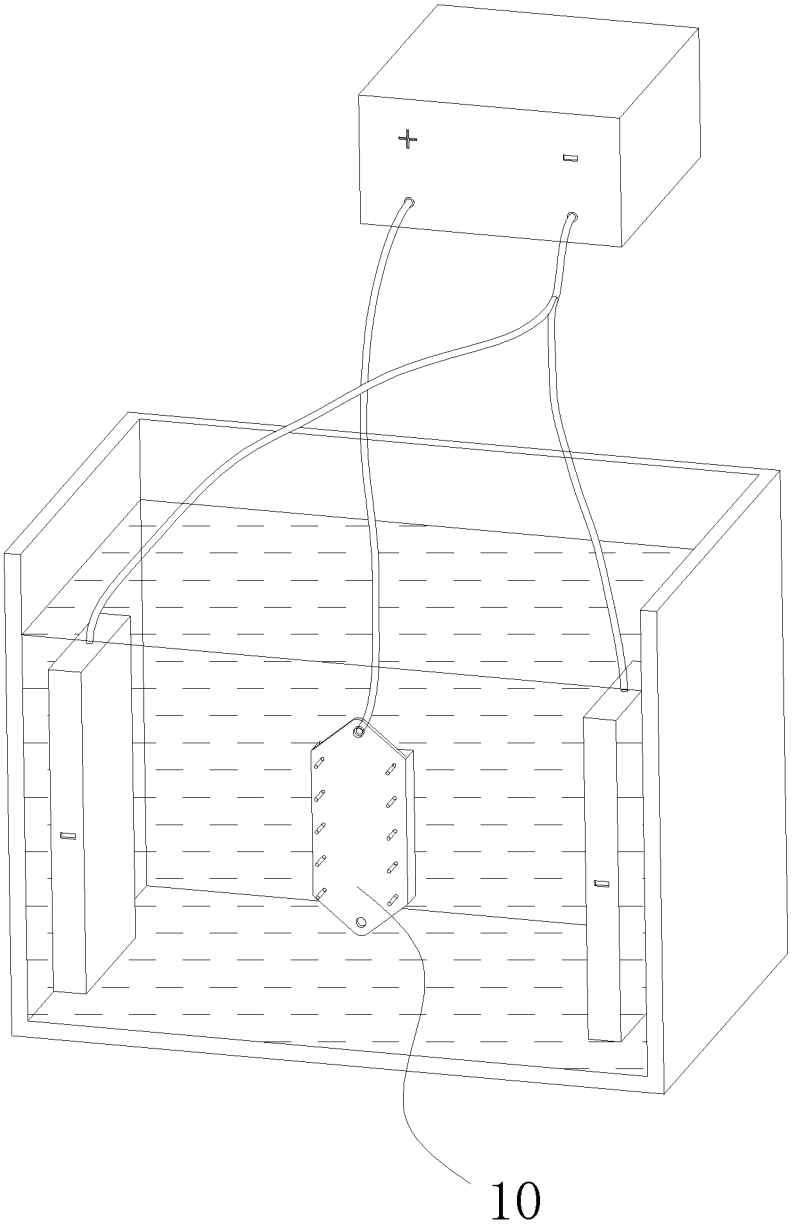
FIG. 3 is a schematic diagram illustrating a process for oxidizing the packaging housing according to some embodiments of the present disclosure.

FIG. 1 is a schematic structural diagram illustrating an exemplary packaging housing according to some embodiments of the present disclosure. FIG. 2 is an exploded view illustrating a packaging housing according to some embodiments of the present disclosure. FIG. 3 is a schematic diagram illustrating a process for oxidizing the packaging housing according to some embodiments of the present disclosure. The technical solutions of the embodiments of the present specification will be described in more detail below with reference to FIGS. 1-3 and the embodiments.

In some embodiments, as shown in FIGS. 1-3, a packaging housing 10 may include a base 11. In some embodiments, the base 11 may be a frame including a bottom surface and a side surface. In some embodiments, at least one lead hole 12 may be provided on the bottom surface of the base 11. In some embodiments, a housing lead 13 may be interpenetrated in the lead hole 12. In some embodiments, the lead hole 12 may be also provided with an insulator 14 surrounding the housing lead 13.

In some embodiments, partial gold plating may be performed on the metal packaging housing. In some embodiments, the method for partial gold plating may include the following operations S1-S4.

In S1, nickel plating. The base 11 and the housing lead 13 are powered on, and a nickel layer is formed by performing nickel plating on the packaging housing 10 as a whole. In some embodiments, specific operations of nickel plating may include impactive nickel plating in S11 and nickel electroplating in S12.

In S11, impactive nickel plating. The packaging housing 10 is placed in a impactive nickel solution after the base 11 and the housing lead 13 are powered on for plating at a solution temperature of 30° C.-60° C. for 0.5 minutes-2 minutes to improve bonding force between the nickel layer and the packaging housing 10. After the plating is completed, the base 11 and the housing lead 13 are powered off, and the packaging housing 10 is taken out, residual impactive nickel solution on the packaging housing 10 is washed with water, and the packaging housing 10 is dried.

In some embodiments, each liter of the impactive nickel solution may include concentrated hydrochloric acid with a mass fraction of 37.5% and nickel chloride, and may be made up to 1 L with deionized water. In some embodiments, a volume of the concentrated hydrochloric acid may be within a range of 50 mL-200 mL. In some embodiments, a volume of the concentrated hydrochloric acid may be within a range of 80 mL-180 mL. In some embodiments, a volume of the concentrated hydrochloric acid may be within a range of 100 mL-150 mL. In some embodiments, a volume of the concentrated hydrochloric acid may be within a range of 120 mL-130 mL. In some embodiments, a mass of the nickel chloride may be within a range of 40 g-65 g. In some embodiments, a mass of the nickel chloride may be within a range of 45 g-60 g. In some embodiments, a mass of the nickel chloride may be within a range of 50 g-55 g.

In S12, nickel electroplating. The packaging housing 10 plated with impactive nickel is placed in a nickel sulfamate solution for plating at a solution temperature of 30° C.-60° C. for 20 minutes-40 minutes to thicken the nickel layer. In some embodiments, the nickel layer may also be thickened using a dark nickel process with a lower nickel ion concentration to improve uniformity of the nickel layer. In some embodiments, after the plating is completed, the packaging housing 10 may be taken out, residual nickel sulfamate solution may be washed with water, and the packaging housing 10 may be dried.

In some embodiments, each liter of the nickel sulfamate solution may include nickel sulfamate, nickel chloride, boric acid, sodium dodecyl sulfonate, and the balance may be deionized water. In some embodiments, a mass of the nickel sulfamate may be within a range of 300 g-450 g. In some embodiments, a mass of the nickel sulfamate may be within a range of 330 g-420 g. In some embodiments, a mass of the nickel sulfamate may be within a range of 350 g-400 g. In some embodiments, a mass of the nickel chloride may be within a range of 5 g-15 g. In some embodiments, a mass of the nickel chloride may be within a range of 8 g-12 g. In some embodiments, a mass of the nickel chloride may be within a range of 10 g-11 g. In some embodiments, a mass of the boric acid may be within a range of 25 g-50 g. In some embodiments, a mass of the boric acid may be within a range of 30 g-45 g. In some embodiments, a mass of the boric acid may be within a range of 35 g-40 g. In some embodiments, a mass of the sodium dodecyl sulfonate may be within a range of 0.1 g-1 g. In some embodiments, a mass of the sodium dodecyl sulfonate may be within a range of 0.3 g-0.8 g. In some embodiments, a mass of the sodium dodecyl sulfonate may be within a range of 0.5 g-0.7 g.

In S2, oxidation. The housing lead 13 is powered off, the base 11 is powered on as an anode and placed in an alkaline solution for oxidation to form an oxide layer on a surface of the nickel layer covering the base 11.

In some embodiments, in S2, specific operations of the oxidation may include: after the base is powered on, placing the base 11 as an anode in the alkaline solution for oxidation, a current density may be within a range of 0.1 $A/dm^2$-10 $A/dm^2$ and an oxidation time may be within a range of 0.1 minutes-10 minutes. In some embodiments, the current density may be within a range of 1 $A/dm^2$-9 $A/dm^2$. In some embodiments, the current density may be within a range of 2 $A/dm^2$-7 $A/dm^2$. In some embodiments, the current density may be within a range of 4 $A/dm^2$-6 $A/dm^2$. In some embodiments, the oxidation time may be within a range of 1 minute-9 minutes. In some embodiments, the oxidation time may be within a range of 3 minutes-7 minutes. In some embodiments, the oxidation time may be within a range of 4 minutes-6 minutes.

In some embodiments, the alkaline solution may include at least one of sodium hydroxide, sodium carbonate, or sodium phosphate, and at least one of 2-mercaptobenzoxazole or 2-mercaptobenzothiazole.

In some embodiments, a mass volume concentration of the sodium hydroxide may be within a range of 1 g/L-10 g/L. In some embodiments, a mass volume concentration of the sodium hydroxide may be within a range of 3 g/L-8 g/L. In some embodiments, a mass volume concentration of the sodium hydroxide may be within a range of 5 g/L-6 g/L.

In some embodiments, a mass volume concentration of the sodium carbonate may be within a range of 1 g/L-10 g/L. In some embodiments, a mass volume concentration of the sodium carbonate may be within a range of 3 g/L-8 g/L. In some embodiments, a mass volume concentration of the sodium carbonate may be within a range of 5 g/L-6 g/L.

In some embodiments, a mass volume concentration of the sodium phosphate may be within a range of 1 g/L-10 g/L. In some embodiments, a mass volume concentration of the sodium phosphate may be within a range of 3 g/L-8 g/L. In some embodiments, a mass volume concentration of the sodium phosphate may be within a range of 5 g/L-6 g/L.

In some embodiments, a mass volume concentration of the 2-mercaptobenzoxazole may be within a range of 0.1 g/L-5 g/L. In some embodiments, a mass volume concentration of the 2-mercaptobenzoxazole may be within a range of 1 g/L-4 g/L. In some embodiments, a mass volume concentration of the 2-mercaptobenzoxazole may be within a range of 2 g/L-3 g/L.

In some embodiments, a mass volume concentration of the 2-mercaptobenzothiazole may be within a range of 0.1 g/L-5 g/L. In some embodiments, a mass volume concentration of the 2-mercaptobenzothiazole may be within a range of 1 g/L-4 g/L. In some embodiments, a mass volume concentration of the 2-mercaptobenzothiazole may be within a range of 2 g/L-3 g/L.

In S3, gold plating. The base 11 is powered off, the housing lead 13 is powered on, a gold layer on a surface of the housing lead 13 is formed by performing gold plating on the housing lead 13. In some embodiments, in S3, specific operations of gold plating may include impactive gold plating in S31 and gold electroplating in S32.

In S31, impactive gold plating. The base 11 is powered off, the housing lead 13 is powered on and placed in a impactive gold solution for plating at a solution temperature of 30-60° C. for 0.1 minutes-2 minutes to enhance bonding force between the gold layer and the nickel layer. After the plating is completed, the housing lead is taken out, residual impactive gold solution on the packaging housing 10 is washed with water, and the packaging housing 10 is dried.

In some embodiments, each liter of impactive gold solution may include potassium aurous cyanide and potassium cyanide, and may be made up to 1 L with deionized water. In some embodiments, a mass of the potassium aurous cyanide may be within a range of 0.2 g-2 g. In some embodiments, a mass of the potassium aurous cyanide may be within a range of 0.5 g-1.5 g. In some embodiments, amass of the potassium aurous cyanide may be within a range of 1.0 g-1.2 g. In some embodiments, a mass of the potassium cyanide may be within a range of 10 g-40 g. In some embodiments, a mass of the potassium cyanide may be within a range of 15 g-35 g. In some embodiments, a mass of the potassium cyanide may be within a range of 20 g-30 g. In some embodiments, a mass of the potassium cyanide may be within a range of 25 g-28 g.

In S32, gold electroplating. The packaging housing 10 plated with impactive gold is placed in a gold plating solution while keeping the housing lead 13 powered on for plating at a solution temperature of 40° C.-70° C. for 3 minutes-10 minutes to thicken the gold layer. After the plating is completed, the packaging housing 10 is taken out, residual gold plating solution on the packaging housing 10 is washed with water and the packaging housing 10 is dried.

In some embodiments, the gold plating solution may be a neutral cyanide gold plating solution or an alkaline cyanide gold plating solution.

In some embodiments, each liter of the neutral cyanide gold plating solution may include potassium aurous cyanide, potassium nickel cyanide, and dipotassium hydrogen phosphate, and may be made up to 1 L with deionized water.

In some embodiments, in each liter of the neutral cyanide gold plating solution, a mass of the potassium aurous cyanide may be within a range of 4 g-7 g. In some embodiments, in each liter of the neutral cyanide gold plating solution, a mass of the potassium aurous cyanide may be within a range of 5 g-6 g.

In some embodiments, in each liter of the neutral cyanide gold plating solution, a mass of the potassium nickel cyanide may be within a range of 1 g-3 g. In some embodiments, in each liter of the neutral cyanide gold plating solution, a mass of the potassium nickel cyanide may be within a range of 2 g-2.5 g.

In some embodiments, in each liter of the neutral cyanide gold plating solution, a mass of the dipotassium hydrogen phosphate may be within a range of 15 g-25 g. In some embodiments, in each liter of the neutral cyanide gold plating solution, a mass of the dipotassium hydrogen phosphate may be within a range of 18 g-23 g. In some embodiments, in each liter of the neutral cyanide gold plating solution, a mass of the dipotassium hydrogen phosphate may be within a range of 19 g-20 g.

In some embodiments, each liter of the alkaline cyanide gold plating solution may include potassium aurous cyanide, potassium cyanide, potassium carbonate, and dipotassium hydrogen phosphate, and may be made up to 1 L with deionized water.

In some embodiments, in each liter of the alkaline cyanide gold plating solution, a mass of the potassium aurous cyanide may be within a range of 1 g-8 g. In some embodiments, in each liter of the alkaline cyanide gold plating solution, a mass of the potassium aurous cyanide may be within a range of 3 g-6 g. In some embodiments, in each liter of the alkaline cyanide gold plating solution, a mass of the potassium aurous cyanide may be within a range of 4 g-5 g.

In some embodiments, in each liter of the alkaline cyanide gold plating solution, a mass of the potassium cyanide may be within a range of 10 g-20 g. In some embodiments, in each liter of the alkaline cyanide gold plating solution, a mass of the potassium cyanide may be within a range of 13 g-18 g. In some embodiments, in each liter of the alkaline cyanide gold plating solution, a mass of the potassium cyanide may be within a range of 15 g-17 g.

In some embodiments, in each liter of the alkaline cyanide gold plating solution, a mass of the potassium carbonate may be within a range of 10 g-20 g. In some embodiments, in each liter of the alkaline cyanide gold plating solution, a mass of the potassium carbonate may be within a range of 13 g-18 g. In some embodiments, in each liter of the alkaline cyanide gold plating solution, a mass of the potassium carbonate may be within a range of 15 g-17 g.

In some embodiments, in each liter of the alkaline cyanide gold plating solution, a mass of the dipotassium hydrogen phosphate may be within a range of 15 g-25 g. In some embodiments, in each liter of the alkaline cyanide gold plating solution, a mass of the dipotassium hydrogen phosphate may be within a range of 18 g-23 g. In some embodiments, in each liter of the alkaline cyanide gold plating solution, a mass of the dipotassium hydrogen phosphate may be within a range of 20 g-21 g.

In S4, reduction. The packaging housing 10 is placed in a high temperature environment, the oxide layer on the surface of the nickel layer of the base 11 is reduced using reducing gas, so that the packaging housing 10 meets a requirement of solderability, and a partial gold-plated packaging housing 10 is obtained.

In some embodiments, the reducing gas may include at least one of hydrogen, carbon monoxide, a gas mixture of nitrogen and hydrogen, a gas mixture of hydrogen and inert gas, a gas mixture of carbon monoxide and nitrogen, or a gas mixture of carbon monoxide and inert gas. In some embodiments, the reducing gas may be a gas mixture of nitrogen and hydrogen, and a volume fraction of hydrogen in the gas mixture of nitrogen and hydrogen may be within a range of 1%-99%. In some embodiments, a volume fraction of hydrogen in the gas mixture of nitrogen and hydrogen may be within a range of 3%-90%. In some embodiments, a volume fraction of hydrogen in the gas mixture of nitrogen and hydrogen may be within a range of 5%-80%. In some embodiments, a volume fraction of hydrogen in the gas mixture of nitrogen and hydrogen may be within a range of 10%-70%. In some embodiments, a volume fraction of hydrogen in the gas mixture of nitrogen and hydrogen may be within a range of 20%-60%. In some embodiments, a volume fraction of hydrogen in the gas mixture of nitrogen and hydrogen may be within a range of 30%-50%. In some embodiments, a volume fraction of hydrogen in the gas mixture of nitrogen and hydrogen may be within a range of 40%-45%. In some embodiments, a processing temperature of the reduction operation may be within a range of 200° C.-400° C. In some embodiments, a processing temperature of the reduction operation may be within a range of 150° C.-350° C. In some embodiments, a processing temperature of the reduction operation may be within a range of 200° C.-300° C.

In some embodiments, the method may also include pre-processing before S1. In some embodiments, the pre-processing may include operations of S01-S03.

In S01, sand blasting. The packaging housing 10 is roughened and leveled (or "ground") under 0.1 $kg/cm^2$-3 $kg/cm^2$ punching using sand.

In some embodiments, the sand may include at least one of silicon carbide sand, copper ore sand, quartz sand, diamond sand, or iron sand.

In some embodiments, a granularity of the sand may be within a range of 100 mesh-400 mesh. In some embodiments, a granularity of the sand may be within a range of 180 mesh-320 mesh. In some embodiments, a granularity of the sand may be within a range of 200 mesh-270 mesh. In some embodiments, a granularity of the sand may be within a range of 220 mesh-250 mesh.

In S02, degreasing. The ground packaging housing 10 is soaked in a degreasing solution with a temperature of 50° C.-70° C. for 5 minutes-15 minutes, the packaging housing 10 is taken out and rinsed with water to remove fingerprints and oil stains on the surface of the packaging housing 10.

In some embodiments, each liter of the degreasing solution may include sodium hydroxide, sodium carbonate, sodium metasilicate, and sodium dodecyl sulfonate, and the balance may be deionized water.

In some embodiments, a mass of the sodium hydroxide may be within a range of 60 g-80 g in each liter of the degreasing solution. In some embodiments, a mass of the sodium hydroxide may be within a range of 65 g-75 g in each liter of the degreasing solution. In some embodiments, a mass of the sodium hydroxide may be within a range of 68 g-70 g in each liter of the degreasing solution.

In some embodiments, a mass of the sodium carbonate may be within a range of 30 g-50 g in each liter of the degreasing solution. In some embodiments, a mass of the sodium carbonate may be within a range of 35 g-45 g in each liter of the degreasing solution. In some embodiments, a mass of the sodium carbonate may be within a range of 38 g-40 g in each liter of the degreasing solution.

In some embodiments, a mass of the sodium metasilicate may be within a range of 10 g-20 g in each liter of the degreasing solution. In some embodiments, a mass of the sodium metasilicate may be within a range of 12 g-18 g in each liter of the degreasing solution. In some embodiments, a mass of the sodium metasilicate may be within a range of 14 g-16 g in each liter of the degreasing solution.

In some embodiments, a mass of the sodium dodecyl sulfonate may be within a range of 3 g-5 g in each liter of the degreasing solution. In some embodiments, a mass of the sodium dodecyl sulfonate may be within a range of 3.5 g-4 g in each liter of the degreasing solution.

In S03, pickling. The degreased packaging housing 10 is soaked in a pickling solution with a temperature of 40° C.-70° C. for 0.1 minutes-2 minutes, and the packaging housing 10 is taken out and rinsed with water to remove rust and oxides on the surface of the packaging housing 10.

In some embodiments, each liter of the pickling solution may include concentrated hydrochloric acid with a mass fraction of 37.5% and deionized water, which may be fully mixed and made up to 1 L. In some embodiments, a volume of the concentrated hydrochloric acid may be within a range of 300 mL-600 mL in each liter of the pickling solution. In some embodiments, a volume of the concentrated hydrochloric acid may be within a range of 350 mL-550 mL in each liter of the pickling solution. In some embodiments, a volume of the concentrated hydrochloric acid may be within a range of 400 mL-500 mL in each liter of the pickling solution. In some embodiments, a volume of the concentrated hydrochloric acid may be within a range of 450 mL-480 mL in each liter of the pickling solution.

In some embodiments, the packaging housing may be prepared using the method for partial gold plating of the metal packaging housing, the nickel layer may be provided on the surface of the base 11 of the packaging housing 10, and the gold layer may be provided on the surface of the housing lead 13 of the packaging housing 10.

In some embodiments, a thickness of the nickel layer may be within a range of 2.5 μm-8.9 μm. In some embodiments, a thickness of the nickel layer may be within a range of 3.0 μm-8.5 μm. In some embodiments, a thickness of the nickel layer may be within a range of 3.5 μm-8.0 μm. In some embodiments, a thickness of the nickel layer may be within a range of 4.0 μm-7.5 μm. In some embodiments, a thickness of the nickel layer may be within a range of 4.5 μm-7.0 μm. In some embodiments, a thickness of the nickel layer may be within a range of 5.0 μm-6.5 μm. In some embodiments, a thickness of the nickel layer may be within a range of 5.5 μm-6.0 μm.

In some embodiments, a thickness of the gold layer may be within a range of 1.3 μm-5.7 μm. In some embodiments, a thickness of the gold layer may be within a range of 1.5 μm-5.5 μm. In some embodiments, a thickness of the gold layer may be within a range of 2.0 μm-5.0 μm. In some embodiments, a thickness of the gold layer may be within a range of 2.5 μm-4.5 μm. In some embodiments, a thickness of the gold layer may be within a range of 3.0 μm-4.0 μm. In some embodiments, a thickness of the gold layer may be within a range of 3.5 μm-3.8 μm.

Embodiment 1

Partial gold plating may be performed on the metal package housing. In this embodiment, the method for partial gold plating may include following operations of S1-S4.

In S1, nickel plating. The base 11 and the housing lead 13 are powered on, a nickel layer is formed by performing nickel plating on the packaging housing 10 as a whole. In this embodiment, specific operations of the nickel plating may include impactive nickel plating in S11 and nickel electroplating in S12.

In S11, impactive nickel plating. The packaging housing 10 is placed in a impactive nickel solution after the base 11 and the housing lead 13 are powered on for plating at a solution temperature of 40° C. for 1 minute. After the plating is completed, the base 11 and the housing lead 13 are powered off, the packaging housing 10 is taken out, residual impactive nickel solution on the packaging housing 10 is washed with water, and the packaging housing 10 is dried.

In this embodiment, each liter of the impactive nickel solution may include 100 mL of concentrated hydrochloric acid with a mass fraction of 37.5% and 40 g of nickel chloride, and may be made up to 1 L with deionized water.

In S12, nickel electroplating. The packaging housing 10 plated with impactive nickel is placed in a nickel sulfamate solution for plating at a solution temperature of 50° C. for 20 minutes, at the same time, the nickel layer is thickened using a dark nickel process with a lower nickel ion concentration. After the plating is completed, the packaging housing 10 is taken out, residual nickel sulfamate solution is washed with water, and the packaging housing 10 is dried.

In this embodiment, each liter of the nickel sulfate solution may include 300 g of nickel sulfamate, 5 g of nickel chloride, 25 g of boric acid, and 0.1 g of sodium dodecyl sulfonate, and the balance may be deionized water.

In S2, oxidation. The housing lead 13 is powered off, the base 11 is powered on as an anode and placed in an alkaline solution for oxidation to form an oxide layer on a surface of the nickel layer covering the base 11.

In this embodiment, in S2, specific operations of the oxidation may include: after the base is powered on, placing the base 11 as an anode in the alkaline solution for oxidation, a current density may be 2 $A/dm^2$ and an oxidation time may be 2 minutes.

In this embodiment, the alkaline solution may include at least one of 1 g/L of sodium hydroxide, 1 g/L of sodium carbonate, or 1 g/L of sodium phosphate, and at least one of 0.5 g/L of 2-mercaptobenzoxazole or 0.5 g/L of 2-mercaptobenzothiazole.

In S3, gold plating. The base 11 is powered off, the housing lead 13 is powered on, and a gold layer on a surface of the housing lead 13 is formed by performing gold plating on the housing lead 13. In this embodiment, in S3, specific operations of gold plating may include impactive gold plating in S31 and gold electroplating in S32.

In S31, impactive gold plating. The base 11 is powered off, the housing lead 13 is powered on and placed in a impactive gold solution for plating at a solution temperature of 30° C. for 1 minute, after the plating is completed, the housing lead is taken out, residual impactive gold solution on the packaging housing 10 is washed with water, and the packaging housing 10 is dried.

In this embodiment, each liter of the impactive gold solution may include 1.5 g of potassium aurous cyanide and 10 g of potassium cyanide, and may be made up to 1 L with deionized water.

In S32, gold electroplating. The packaging housing 10 plated with impactive gold is placed in a gold plating solution while keeping the housing lead 13 powered on for plating at a solution temperature of 50° C. for 10 minutes, after the plating is completed, the packaging housing 10 is taken out, residual gold plating solution on the packaging housing 10 is washed with water and the packaging housing 10 is dried.

In this embodiment, the gold plating solution may be a neutral cyanide gold plating solution. In this embodiment, each liter of the cyanide gold plating solution may include 4 g of potassium aurous cyanide, 1 g of potassium nickel cyanide, and 15 g of dipotassium hydrogen phosphate, and may be made up to 1 L with deionized water.

In S4, reduction. The packaging housing 10 is placed in a high temperature environment, a partial gold-plated packaging housing 10 is obtained by reducing the oxide layer on the surface of the nickel layer of the base 11 using reducing gas. In a gas mixture of nitrogen and hydrogen, a volume fraction of hydrogen may be 5%, and a processing temperature may be 300° C.

In this embodiment, the method may also include pre-processing before S1. In this embodiment, the pre-processing may include operations of S01-S03.

In S01, sand blasting. The packaging housing 10 is roughened and leveled under 1 $kg/cm^2$ punching using 220-mesh of silicon carbide sand.

In S02, degreasing. The ground packaging housing 10 is soaked in a degreasing solution with a temperature of 50° C. for 5 minutes, and the packaging housing 10 is taken out and rinsed with water to remove fingerprints and oil stains on the surface of the packaging housing 10.

In this embodiment, each liter of the degreasing solution may include 60 g of sodium hydroxide, 30 g of sodium carbonate, 10 g of sodium metasilicate, and 3 g of sodium dodecyl sulfonate, and the balance may be deionized water.

In S03, pickling. The degreased packaging housing 10 is soaked in a pickling solution with a temperature of 40° C. for 1 minute, and the packaging housing 10 is taken out and rinsed with water to remove rust and oxides on the surface of the packaging housing 10.

In this embodiment, each liter of the pickling solution may include 300 mL of concentrated hydrochloric acid with a mass fraction of 37.5%, and may be fully mixed and made up to 1 L with deionized water.

The packaging housing may be prepared using the method for partial gold plating of the metal packaging housing. The nickel layer may be provided on the surface of the base 11 of the packaging housing 10, and the gold layer may be provided on the surface of the housing lead 13 of the packaging housing 10. A thickness of the nickel layer may be 3 μm. A thickness of the gold layer may be 1.3 μm.

Embodiment 2

Partial gold plating may be performed on the metal package housing. In this embodiment, the method for partial gold plating may include following operations of S1-S4.

In S1, nickel plating. The base 11 and the housing lead 13 are powered on, a nickel layer is formed by performing nickel plating on the packaging housing 10 as a whole. In some embodiments, the specific operations of nickel plating may include impactive nickel plating in S11 and nickel electroplating in S12.

In S11, impactive nickel plating. The packaging housing 10 is placed in a impactive nickel solution after the base 11 and the housing lead 13 are powered on for plating at a solution temperature of 50° C. for 2 minutes. After the plating is completed, the base 11 and the housing lead 13 are powered off, the packaging housing 10 is taken out, residual impactive nickel solution on the packaging housing 10 is washed with water, and the packaging housing 10 is dried.

In this embodiment, each liter of the impactive nickel solution may include 200 mL of concentrated hydrochloric acid with a mass fraction of 37.5% and 65 g of nickel chloride, and may be made up to 1 L with deionized water.

In S12, nickel electroplating. The packaging housing 10 plated with impactive nickel is placed in a nickel sulfamate solution for plating at a solution temperature of 55° C. for 40 minutes, at the same time, the nickel layer is thickened using a dark nickel process with a lower nickel ion concentration. After the plating is completed, the packaging housing 10 is taken out, residual nickel sulfamate solution is washed with water, and the packaging housing 10 is dried.

In this embodiment, each liter of the nickel sulfate solution may include 450 g of nickel sulfamate, 15 g of nickel chloride, 50 g of boric acid, and 1 g of sodium dodecyl sulfonate, and the balance may be deionized water.

In S2, oxidation. The housing lead 13 is powered off, the base 11 is powered on and placed in an alkaline solution for oxidation to form an oxide layer on a surface of the nickel layer covering the base 11.

In this embodiment, in S2, specific operations of the oxidation may include: after the base is powered on, placing the base 11 as an anode in the alkaline solution for oxidation, a current density may be 2 A/dm$^2$ and an oxidation time may be 10 minutes.

In this embodiment, the alkaline solution may include at least one of 10 g/L of sodium hydroxide, 10 g/L of sodium carbonate, or 10 g/L of sodium phosphate, and at least one of 1 g/L of 2-mercaptobenzoxazole or 1 g/L of 2-mercaptobenzothiazole.

In S3, gold plating. The base 11 is powered off, the housing lead 13 is powered on, a gold layer on a surface of the housing lead 13 is formed by performing gold plating on the housing lead 13. In this embodiment, in S3, specific operations of gold plating may include impactive gold plating in S31 and gold electroplating in S32.

In S31, impactive gold plating. The base 11 is powered off, the housing lead 13 is powered on and placed in a impactive gold solution for plating at a solution temperature of 60° C. for 20 seconds. After the plating is completed, the housing lead is taken out, residual impactive gold solution on the packaging housing 10 is washed with water, and the packaging housing 10 is dried.

In this embodiment, each liter of the impactive gold solution may include 2 g of potassium aurous cyanide and 40 g of potassium cyanide, and may be made up to 1 L with deionized water.

In S32, gold electroplating. The packaging housing 10 plated with impactive gold is placed in a gold plating solution while keeping the housing lead 13 powered on for plating at a solution temperature of 70° C. for 10 minutes. After the plating is completed, the packaging housing 10 is taken out, residual gold plating solution on the packaging housing 10 is washed with water and the packaging housing 10 is dried.

In this embodiment, the gold plating solution may be an alkaline cyanide gold plating solution. In this embodiment, each liter of the alkaline cyanide gold plating solution may include 8 g of potassium aurous cyanide, 20 g of potassium cyanide, 20 g of potassium carbonate, and 25 g of dipotassium hydrogen phosphate, and may be made up to 1 L with deionized water.

In S4, reduction. The packaging housing 10 is placed in a high temperature environment, a partial gold-plated packaging housing 10 is obtained by reducing the oxide layer on the surface of the nickel layer of the base 11 using reducing gas. In a gas mixture of nitrogen and hydrogen, hydrogen may account for 3% of a total volume of the gas mixture, and a processing temperature may be 350° C.

In this embodiment, the solution may also include pre-processing before S1. In this embodiment, the pre-processing may include operations of S01-S03.

In S01, sand blasting. The packaging housing 10 is roughened and leveled under 0.8 kg/cm$^2$ punching using 320 mesh silicon carbide sand.

In S02, degreasing. The ground packaging housing 10 is soaked in a degreasing solution with a temperature of 70° C. for 15 minutes, the packaging housing 10 is taken out and rinsed with water to remove fingerprints and oil stains on the surface of the packaging housing 10.

In this embodiment, each liter of the degreasing solution may include 80 g of sodium hydroxide, 50 g of sodium carbonate, 20 g of sodium metasilicate, and 4 g of sodium dodecyl sulfonate, and the balance may be deionized water.

In S03, pickling. The degreased packaging housing 10 is soaked in a pickling solution with a temperature of 65° C. for 15 seconds, and the packaging housing 10 is taken out and rinsed with water to remove rust and oxides on the surface of the packaging housing 10.

In this embodiment, each liter of the pickling solution may include 600 mL of concentrated hydrochloric acid with a mass fraction of 37.5%, and may be fully mixed and made up to 1 L with deionized water.

The packaging housing may be prepared using the method for partial gold plating of the metal packaging housing, the nickel layer may be provided on the surface of the base 11 of the packaging housing 10, and the gold layer may be provided on the surface of the housing lead 13 of the packaging housing 10. A thickness of the nickel layer may be 8 μm. A thickness of the gold layer may be 2.5 μm.

The above are merely preferred embodiments of the present disclosure, which are not intended to limit the present disclosure. Although the present disclosure has been described in detail with reference to the foregoing embodiments, it should be understood by those skilled in the art that any modification, equivalent replacement and improvement made within the spirit and principle of the present disclosure shall be included in the protection scope of the present disclosure.

What is claimed is:

1. A method for partial gold plating of a metal packaging housing, wherein the packaging housing includes a base, the base is provided with at least one lead hole, a housing lead is interpenetrated in the at least one lead hole, the at least one lead hole is also provided with an insulator surrounding the housing lead, the method comprising:

S1, nickel plating; powering on the base and the housing lead, and forming a nickel layer by performing nickel plating on the packaging housing as a whole;

S2, oxidation; powering off the housing lead, powering on the base and placing the base in an alkaline solution for oxidation to form an oxide layer on a surface of the nickel layer covering the base;

S3, gold plating; powering off the base, powering on the housing lead, and forming a gold layer on a surface of the housing lead by performing gold plating on the housing lead; and S4, reduction; placing the packaging housing in a high temperature environment, and obtaining a partial gold-plated packaging housing by reducing the oxide layer on the surface of the nickel layer of the base using a gas mixture of nitrogen and hydrogen.

2. The method of claim 1, wherein in S1, the nickel plating includes:

S11, impactive nickel plating, placing the packaging housing in a impactive nickel solution after powering on the base and the housing lead for plating at a solution temperature of 30° C.-60° C. for 0.5 minutes-2 minutes, powering off the base and the housing lead, taking out the packaging housing, and washing residual impactive nickel solution with water; and S12, nickel electroplating, placing the packaging housing plated with impactive nickel in a nickel sulfamate solution for plating at a solution temperature of 30° C.-60° C. for 20 minutes-40 minutes, powering off the base and the housing lead, taking out the packaging housing, and washing nickel sulfamate residual solution with water.

3. The method of claim 2, wherein each liter of the impactive nickel solution includes 50 mL-200 mL of concentrated hydrochloric acid with a mass fraction of 37.5% and 40 g-65 g of nickel chloride, and the balance is deionized water.

4. The method of claim 2, wherein each liter of the nickel sulfamate solution includes 300 g-450 g of nickel sulfamate, 5 g-15 g of nickel chloride, 25 g-50 g of boric acid, and 0.1 g-1 g of sodium dodecyl sulfonate, and the balance is deionized water.

5. The method of claim 1, wherein in S2, the oxidation includes: after the base is powered on, placing the base as an anode in the alkaline solution for oxidation, wherein a current density is within a range of 0.1 A/dm2-10 A/dm2 and an oxidation time is within a range of 0.1 minutes-10 minutes.

6. The method of claim 1, wherein the alkaline solution includes at least one of 1 g/L-10 g/L of sodium hydroxide, 1 g/L-10 g/L of sodium carbonate, or 1 g/L-10 g/L of sodium phosphate, and at least one of 0.1 g/L-5g/L of 2-mercaptobenzoxazole or 0.1 g/L-5g/L of 2-mercaptobenzothiazole.

7. The method of claim 1, wherein in S3, the gold plating includes:

S31, impactive gold plating, powering off the base, powering on the housing lead and placing the housing lead in a impactive gold solution for plating at a solution temperature of 30° C.-60° C. for 0.1 minutes-2 minutes, powering off and taking out the housing lead, and washing residual impactive gold solution with water; and S32, gold electroplating, placing the packaging housing plated with impactive gold in a gold plating solution while keeping the housing lead powered on for plating at a solution temperature of 40° C.-70° C. for 3 minutes-10 minutes, taking out the packaging housing after powering off the housing lead, and washing residual gold plating solution with water.

8. The method of claim 7, wherein each liter of the impactive gold solution includes 0.2 g-2 g of potassium aurous cyanide, 10 g-40 g of potassium cyanide, and the balance is deionized water.

9. The method of claim 7, wherein the gold plating solution is a neutral cyanide gold plating solution or an alkaline cyanide gold plating solution.

10. The method of claim 9, wherein each liter of the neutral cyanide gold plating solution includes 4 g-7 g of potassium aurous cyanide, 1 g-3 g of potassium nickel cyanide, and 15 g-25 g of dipotassium hydrogen phosphate, and the balance is deionized water.

11. The method of claim 9, wherein each liter of the alkaline cyanide gold plating solution includes 1 g-8 g of potassium aurous cyanide, 10 g-20 g of potassium cyanide, 10 g-20 g of potassium carbonate, and 15 g-25 g of dipotassium hydrogen phosphate, and the balance is deionized water.

12. The method of claim 1, wherein in S4, a volume fraction of hydrogen in the gas mixture of nitrogen and hydrogen is within a range of 1%-99%, and a processing temperature is within a range of 200° C.-400° C.

13. The method of claim 1, further comprising pre-processing before S1, wherein the pre-processing includes:

S01, sand blasting, grinding the packaging housing under 0.1 kg/cm2-3 kg/cm2 punching using silicon carbide of 100 mesh-400 mesh;

S02, degreasing, soaking the ground packaging housing in a degreasing solution with a temperature of 50° C.-70° C. for 5 minutes-15 minutes, taking out and rinsing the packaging housing with water; and S03, pickling, soaking the degreased packaging housing in a pickling solution with a temperature of 40° C.-70° C. for 0.1 minutes-2 minutes, taking out and rinsing the packaging housing with water.

14. The method of claim 13, wherein each liter of the degreasing solution includes 60 g-80 g of sodium hydroxide, 30 g-50 g of sodium carbonate, 10 g-20 g of sodium metasilicate, 3 g-5 g of sodium dodecyl sulfonate, and the balance is deionized water.

15. The method of claim 13, wherein each liter of the pickling solution includes 300 mL-600 mL of concentrated hydrochloric acid with a mass fraction of 37.5%, and the balance is deionized water.

* * * * *